US009136627B2

(12) United States Patent
Miura

(10) Patent No.: US 9,136,627 B2
(45) Date of Patent: Sep. 15, 2015

(54) FLAT CIRCUIT CONNECTOR CONFIGURED TO PROVIDE ENHANCED CONNECTOR STABILIZATION

(71) Applicant: YAZAKI CORPORATION, Tokyo (JP)

(72) Inventor: Kazunori Miura, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 13/967,831

(22) Filed: Aug. 15, 2013

(65) Prior Publication Data

US 2013/0330963 A1 Dec. 12, 2013

Related U.S. Application Data

(63) Continuation of application No. PCT/JP2012/053565, filed on Feb. 15, 2012.

(30) Foreign Application Priority Data

Feb. 25, 2011 (JP) ..... 2011-039686

(51) Int. Cl.

| | |
|---|---|
| ***H01R 12/24*** | (2006.01) |
| ***H01R 12/77*** | (2011.01) |
| *H01R 13/506* | (2006.01) |
| *H01R 13/52* | (2006.01) |

(52) U.S. Cl.

CPC ..... *H01R 12/777* (2013.01); *H01R 12/778* (2013.01); *H01R 13/506* (2013.01); *H01R 13/5202* (2013.01)

(58) Field of Classification Search

CPC ..... H01R 13/516

USPC ..... 439/353, 492, 587

See application file for complete search history.

(56) References Cited

U.S. PATENT DOCUMENTS

| | | | | |
|---|---|---|---|---|
| 5,080,603 | A * | 1/1992 | Mouissie | 439/353 |
| 6,454,594 | B2 | 9/2002 | Sawayanagi | |

(Continued)

FOREIGN PATENT DOCUMENTS

| | | | |
|---|---|---|---|
| CN | 1886866 | A | 12/2006 |
| CN | 101919124 | A | 12/2010 |

(Continued)

OTHER PUBLICATIONS

English translation of International Search Report for PCT Patent App. No. PCT/JP2012/053565 (Apr. 17, 2012).

(Continued)

*Primary Examiner* — Tho D Ta

(74) *Attorney, Agent, or Firm* — Kenealy Vaidya LLP

(57) ABSTRACT

A flat circuit connector includes a first connector which is resin molded at an end part of a flat circuit body and a second connector including a terminal. The first connector includes a block part made of resin and a flange part. The flange part is integrally formed at a rear side in a direction in which the block part is fitted. A projecting wall is provided on a surface of the flange part which is parallel to a main surface of the flat circuit body. The second connector includes a first peripheral wall with which the block part is fitted, and a second peripheral wall which is integrally formed at the rear side of the first peripheral wall. The second peripheral wall is formed with a cut part in which the projecting wall is fitted.

8 Claims, 6 Drawing Sheets

(56) References Cited

U.S. PATENT DOCUMENTS

| | | | | |
|---|---|---|---|---|
| 6,638,090 | B2 * | 10/2003 | Wakata | 439/492 |
| 7,883,359 | B2 * | 2/2011 | Osaki et al. | 439/492 |
| 2006/0240701 | A1 | 10/2006 | Schremmer et al. | |
| 2010/0279541 | A1 | 11/2010 | Osaki et al. | |

FOREIGN PATENT DOCUMENTS

| | | | |
|---|---|---|---|
| EP | 0 415 489 | A1 | 3/1991 |
| JP | 6-310224 | A | 11/1994 |
| JP | 7-106016 | A | 4/1995 |
| JP | 11-16628 | A | 1/1999 |
| JP | 2001-155815 | A | 6/2001 |
| JP | 2002-170627 | A | 6/2002 |
| JP | 2005-93269 | A | 4/2005 |
| JP | 2008-176977 | A | 7/2008 |
| KR | 20-0427992 | Y1 | 10/2006 |
| KR | 10-2010-0105668 | A | 9/2010 |

OTHER PUBLICATIONS

English translation of Written Opinion for PCT Patent App. No. PCT/JP2012/053565 (Apr. 17, 2012).
International Search Report and Written Opinion of the International Search Report for PCT/JP2012/053565 dated Apr. 17, 2012.
Korean Office Action for the related Korean Patent Application No. 10-2013-7022395 dated Jul. 17, 2014.
The Korean Office Action for the related Korean Patent Application No. 10-2013-7022395 dated Jan. 13, 2015.
Chinese Office Action for the related Chinese Patent Application No. 201280010386.3 dated Mar. 25, 2015.
Korean Office Action for the related Korean Patent Application No. KR10-2013-7022395 dated Jul. 16, 2015.

* cited by examiner

FLAT CIRCUIT CONNECTOR CONFIGURED TO PROVIDE ENHANCED CONNECTOR STABILIZATION

CROSS REFERENCE TO RELATED APPLICATIONS

This application is a continuation of PCT application No. PCT/JP2012/053565, which was filed on Feb. 15, 2012 based on Japanese Patent Application (No. 2011-039686) filed on Feb. 25, 2011, the contents of which are incorporated herein by reference.

BACKGROUND

The present invention relates to a flat circuit connector for which while a resin molded part formed at an end of a flat circuit body is fitted in a mating connector, the flat circuit body and a terminal in the mating connector are connected.

FIG. 16 shows one embodiment of a conventional flat circuit connector (refer to Patent Document 1).

A flat circuit connector 61 has a first connector (plug connector) 62 and a second connector (receptacle connector) 63. The first connector 62 has a supporting and reinforcing member (also indicated by the number 62) molded by resin at an end of a flat harness 64. A terminal conductor 64*a* is exposed on a supporting part 62*a*. The conductor 64*a* is reinforced by a reinforcing part 62*b* around the end, and locking projections 65 are provided on the side surfaces of the reinforcing part 62*b*.

The second connector 63 has a connecting terminal 67 at an upper part inside a connector housing 66 made of resin, has a taper surface 66*a* at a bottom part which supports a taper surface of the supporting part 62*a*, and has locking holes at side walls corresponding to the locking projections 65.

FIG. 17 shows an example in which a sealing member 68 is formed around the reinforcing part 62*b* in the first connector 62. When the connectors are fitted, the sealing member 68 adheres to the inner surface of the second connector 63 as shown in FIG. 16, and is positioned with a gap between the bottom surface of the supporting part 62*a* and the bottom surface 66*b* of the connector housing 66.

Besides the above flat circuit connector, for example, it is disclosed (not shown in the figure) in Patent Document 2 that terminals of flat cables are accommodated in a first and a second connectors, and pressed and fixed respectively by retainers made of resin, and the rear side of the retainers are filled by a resin molded part to be waterproofed. It is disclosed in Patent Document 3 that connecting terminals are connected to electric wires at a terminal of a flat cable, and the connecting part is covered by a resin mold part to be waterproofed. It is disclosed in a patent document 4 that a plurality of connecting terminals are joined by primary molding resin, and a connecting part of the connecting terminals and terminal connectors of a flat cable is covered with secondary molding resin on the primary molding resin to be waterproofed.

[Patent Document 1] JP-A-2005-93269 (FIGS. 4 and 7)

[Patent Document 2] JP-A-2008-176977 (FIG. 2)

[Patent Document 3] JP-A-7-106016 (FIG. 2)

[Patent Document 4] JP-A-6-310224 (FIGS. 1 and 4)

SUMMARY

However, in the above traditional flat circuit connector 61 shown in FIG. 16, for example, an insertion range or an insertion gap in the up-down direction of the right and left locking projections 65 of the first connector 62 is set relative to the second connector 63. Therefore, a wobble in the up-down or right-left direction between the first connector 62 and the second connector 63 occurs easily. Particularly, when an external force in a bending direction or a twisting direction, in other words, in the up-down or right-left direction is applied on the flat harness (flat circuit body) 64 or the flat harness 64 receives vibrations of a vehicle or the like, there are concerns that electrical contact of the conductor 64*a* of the flat harness 64 and the connecting terminal 67 may get worse or even lost.

The present invention is made in view of the above situations, and the object of the present invention is to provide a flat circuit connector which can prevent a wobble of the connectors relative to each other even when an external force is applied on the flat circuit body.

The above object of the present invention is accomplished by flat circuit connectors having constructions of following (1) to (5).

(1) A flat circuit connector comprising:

a first connector which is resin molded at an end part of a flat circuit body; and a second connector, including a terminal configured to connect to a conductor provided in the end part, and configured to be fitted with the first connector, wherein the first connector includes a block part made of resin and a flange part, the flange part is integrally formed at a rear side in a direction in which the block part is fitted and has a diameter larger than a diameter of the block part, a projecting wall is provided on a surface of the flange part which is parallel to a main surface of the flat circuit body, the second connector includes a first peripheral wall with which the block part is fitted, and a second peripheral wall which is integrally formed at the rear side of the first peripheral wall in the direction in which the block part is fitted, and the second peripheral wall is formed with a cut part in which the projecting wall is fitted.

According to the flat circuit connector which has the configuration in the above (1), the block part of the first connector is fitted in the first peripheral wall of the second connector, the flange part which is formed at the rear side in the direction the block part is fitted is fitted with the inner side of the second peripheral wall which is provided to be connected to the first peripheral wall, and the projecting wall which is provided on the surface of the flange part parallel to the main surface of the flat circuit body is fitted in the cut part of the second peripheral wall. Thereby, a wobble in an up-down or right-left direction of the two connectors is prevented. The up-down direction is the thickness direction of the flat circuit body, and the right-left direction is the width direction of the flat circuit body.

(2) The flat circuit connector according to the (1) above, wherein the second peripheral wall is provided with a locking part which is flexible in a width direction of the flat circuit body, and the flange part is provided with a locked part configured to be engaged with the locking part.

According to the flat circuit connector which has the configuration in the above (2), while the locking part of the second peripheral wall is bended outwards to be engaged with the locked part of the flange part, the flange part is fitted in the second peripheral wall without a gap. With the engagement of the locking part and the locked part, the two connectors are locked with each other.

(3) The flat circuit connector according to the (1) or (2) above, wherein a groove part is provided between the block part and a projecting plate part which is provided forward at a distal end part of the projecting wall at a front side in the direction in which the block part is fitted, and the first peripheral wall is configured to be fitted in the groove part.

According to the flat circuit connector which has the configuration in the above (3), wall parts of the first peripheral wall are fitted in the groove part, the outer surfaces of the wall parts contact with the inner surface of the projecting plate part, and the inner surface of the wall parts contacts with the outer surface of the block part so that a wobble between the two connectors in the up-down direction is prevented more surely.

(4) The flat circuit connector according to the (1) or (2) above, wherein an elastic sealing member is provided on an outer periphery of the block part, and the sealing member adheres to an inner surface of the first peripheral wall.

According to the flat circuit connector which has the configuration in the above (4), the outer peripheral surface of the block part and the inner surface of the first peripheral wall are elastically pressed in the inner-outer direction (the radial direction of the sealing member) by the sealing member so that a wobble between the block part and the first peripheral wall is prevented. The space between the block part and the first peripheral wall is waterproofed by the sealing member so that water can be prevented from leaking into the connectors.

(5) The flat circuit connector according to the (3) above, wherein an elastic sealing member is provided on an outer periphery of the block part, and the sealing member adheres to an inner surface of the first peripheral wall.

According to the flat circuit connector which has the configuration in the above (5), the outer peripheral surface of the block part and the inner surface of the first peripheral wall are elastically pressed in the inner-outer direction (the radial direction of the sealing member) by the sealing member so that a wobble between the block part and the first peripheral wall is prevented. The space between the block part and the first peripheral wall is waterproofed by the sealing member so that water can be prevented from leaking into the connectors.

According to the configuration described in the above (1), a wobble of the connectors relative to each other in the up-down or right-left direction can be prevented even when an external force is applied on the flat circuit body. Thereby, abrasion of the conductors of the flat circuit body and the terminals of the second connector is prevented and electrical contact can be well maintained.

According to the configuration described in the above (2), since the locking part is bended to be engaged with the locked part, the flange part can be fitted in the second peripheral wall without a gap, and thereby, a wobble of the two connectors particularly in the right-left direction can be prevented surely.

According to the configuration described in the above (3), since the first peripheral wall is fitted in the groove part, a wobble of the two connectors particularly in the up-down direction is prevented more surely, and thereby, the effects of the configuration described in the above (1) can be increased.

For the conventional waterproof sealing configuration shown in FIG. 17, when an external force in the up-down or right-left direction is applied like the above described situation, the adhesion of the sealing part 68 may decrease.

In contrast, according to the configuration described in the above (4), since a wobble of the connectors relative to each other is prevented by the configurations described in the above (1) and (2), unfavorable deformation of the sealing member is prevented and the waterproofness of the connectors can be well maintained. A wobble between the two connectors is prevented by the elasticity of the sealing member itself, and the waterproofness can be further improved.

As a result, a flat circuit connector can be provided so that a wobble of the connectors relative to each other can be prevented even when an external force is applied on the flat circuit body and the waterproofness can be well maintained even when an external force is applied on the flat circuit body.

According to the configuration described in the above (5), since a wobble of the connectors relative to each other is prevented by the configuration described in the above (3), unfavorable deformation of the sealing member is prevented and the waterproofness of the connectors can be well maintained. A wobble between the two connectors is prevented by the elasticity of the sealing member itself, and the waterproofness can be further improved.

As a result, a flat circuit connector can be provided so that a wobble of the connectors relative to each other can be prevented even when an external force is applied on the flat circuit body and the waterproofness can be well maintained even when an external force is applied on the flat circuit body.

DETAILED DESCRIPTION OF EXEMPLIFIED EMBODIMENTS

FIGS. 1 to 8 show the flat circuit connector of the first embodiment according to the present invention.

Figure 1:
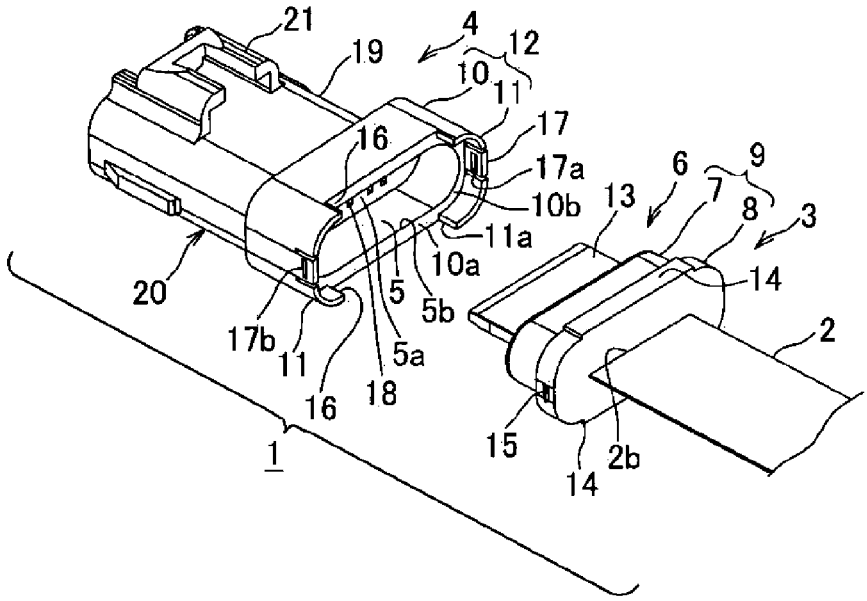
FIG. 1 is an exploded perspective view of a flat circuit connector of a first embodiment according to the present invention.

As shown in FIG. 1, a flat circuit connector 1 includes a first connector 3 which is integrally resin molded at an end part 2*b* of a flexible flat circuit body 2 which has a main board formed of FPC or FFC into a flat shape, and a second connector 4 which has a connector fitting room 5 which accommodates the first connector 3 as well as the end part 2*b* of the flat circuit body 2 and is fitted with the first connector 3. A fitted part (fixed part) 9 with a front side part and a rear side part is at the rear side of an insulative resin molded part 6 of the first connector 3. The fitted part 9 includes a front side block part 7 and a rear side flange part 8, and the block part 7 and the flange part are integrally formed. The second connector 4 has a peripheral wall part 12 with a front part and a rear part which accommodates the fitted part 9.

In this specification, the longitudinal direction of the flat circuit body 2 is a front-rear direction: the side of the end part 2*b* is a front side and the other end side is a rear side. That is, the direction in which the first connector 3 and the second connector 4 are fitted is the front-rear direction, the direction the first connector 3 is inserted into the second connector 4 is a forward direction, and the direction the first connector 3 is pulled out of the second connector 4 is a rearward direction. The width direction of the flat circuit body 2 is a right-left direction and the thickness direction of the flat circuit body 2 is an up-down direction. However, in the specification, the directions of upward, downward, frontward, rearward, rightward and leftward are used for convenience, and the front-rear direction, for example, may not correspond to the direction the first connector 3 and the second connector 4 are fitted. The "front-rear" of the second connector 4 is based on the "front-rear" of the first connector 3.

The resin molded part 6 of the first connector 3 includes a flat-shaped insulative contact cover 13 which is integrally formed and projected from the front side of the block part 7. The flange part 8 has a pair of long projecting walls (reinforcing parts) 14 which extends in the right-left direction on the top and bottom surfaces parallel to the main board of the flat circuit body 2, and has a pair of locking projections (locked parts) 15 at the right and left side surfaces.

The peripheral wall part 12 of the second connector 4 includes a first peripheral wall 10 which has a generally ellipse shape and is formed continuously at the front side and second peripheral walls 11 which are integrally formed with the distal end side (the rear side) of the first peripheral wall 10 and are fitted with the flange part 8. The outer surfaces of the second peripheral walls 11 follow the same surface as the outer surface of the first peripheral wall 10, inner surfaces of the second peripheral walls 11 are perpendicular to a distal end surface (rear end side surface) 10*a* of the first peripheral wall 10, and parts 10*b* of the distal end surface 10*a* are positioned at the inner sides of the second peripheral walls 11.

The second peripheral walls 11 are formed with a pair of rectangular cut parts 16 to fit with the projecting walls 14 of the first connector 3, and the second peripheral walls 11 are provided as a pair of right and left generally arc shaped thin parts. The cut parts 16 are formed between two right and left end surfaces 11*a* of the second peripheral walls 11, and are constructed by being surrounded by three parts: the top or bottom distal end surface 10*a* of the first peripheral wall 10 and the two right and left end surfaces 11*a* of the second peripheral walls 11. Each of the second peripheral walls 11 has a flexible locking frame (locking part) 17 at the center. Each of the flexible locking frames 17 is separated from the second peripheral wall 11 by top and bottom slits 17*a* and has a rectangular locking hole 17*b* at the center to be engaged with the locking projection 15 of the first connector 3.

In this embodiment, the pair of projecting walls 14 are formed on the top and bottom surfaces of the flange part 8 and the second peripheral walls 11 are formed with the pair of cut parts 16 to fit with the pair of projecting walls 14. But it is also possible that, the projecting wall 14 is formed on at least one of the top and bottom surfaces of the flange part 8 and the second peripheral wall 11 is formed with the cut part 16 at a position corresponding to the projecting wall 14 to fit with the projecting wall 14.

The connector fitting room 5 is positioned at the inner side of the first peripheral wall 10, and a plurality of terminal accommodating rooms 18 are opened at a vertical bottom wall 5*a* of the connector fitting room 5. The cut parts 16 are positioned above and below a rear opening 5*b* of the connector fitting room 5, and the second peripheral walls 11 are positioned to the right and left of the rear opening 5*b*. A housing main body part 19 which has a diameter smaller than that of the peripheral wall part 12 is integrally connected with the front side of the peripheral wall part 12. A connector housing 20 made of insulative resin are formed of the peripheral wall part 12 and the housing main body part 19. The housing main body part 19 has a slide fixed part 21 which is fixed to a vehicle panel or the like.

Figure 2:
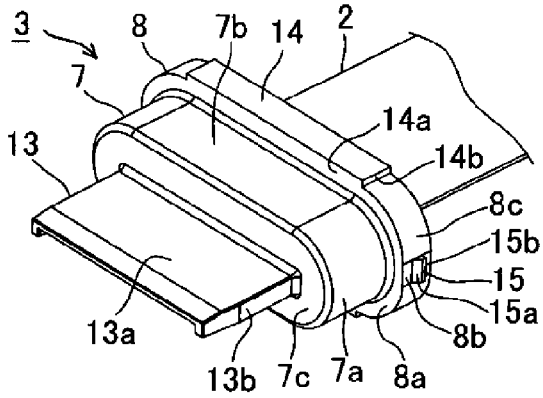
FIG. 2 is a perspective view of a flat circuit side connector shown in FIG. 1.

As shown in FIG. 2, the block part 7 of the first connector 3 is formed into a generally ellipse shape to match the shape of the connector fitting room 5 (the inner surface of the first peripheral wall 10) of the second connector 4 shown in FIG. 1, and has semicircular curved surfaces 7*a* at the right and left sides, horizontal flat surfaces 7*b* at the top and bottom and a vertical surface 7*c* at the front end. The contact cover 13 is integrally formed and projected from the center in the height direction of the front end surface 7*c*, and the contact cover 13 has a horizontal wide upper board part 13*a* and right and left narrow side board parts 13*b*.

The flange part 8 at the rear end is formed to be slightly larger than the block part 7 and thinner in the front-rear direction than the block part 7, and has a vertical front end surface 8*a* which is perpendicular to the outer peripheral surfaces (curved surfaces 7*a*, flat surfaces 7*b*) of the block part 7 and follows the same surfaces as front end surfaces 14*a* of the top and bottom projecting walls 14. The projecting walls 14 are formed to have the same thickness as that of the second peripheral walls 11 of the second connector 4, and have narrow vertical side surfaces 14*b* at the right and left sides.

The right and left ends of the flange part 8 has narrow, flat, vertical side surfaces 8*b* to contact with the inner surfaces of the locking frames 17 of the second connector 4, and the locking projections 15 at the center in the front-rear direction of the side surfaces 8*b*. The locking projection 15 has an inclined guide surface 15*a* at the front side and a generally vertical locking surface 15*b* at the rear side.

Figure 3:
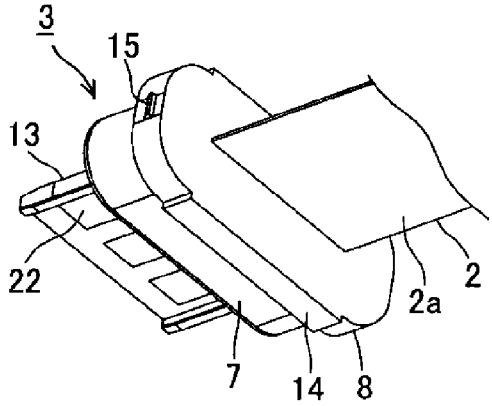
FIG. 3 is a perspective view of the flat circuit side connector shown in FIG. 1 which is viewed from below.

As shown in FIG. 3, a plurality of (in this example, three) paralleled conductors 22 of the flat circuit body 2 are exposed on the inner surface (the back surface) of the contact cover 13 of the first connector 3. The conductors 22 are connected to inner conductors (not shown in the figure) which are covered with horizontal insulative sheets (films) 2*a* at the top and bottom of the flat circuit body 2.

The conductors 22 may be the inner conductors, or may be separate conductors 22 which are connected to the inner conductors. For example, the contact cover 13 can be omitted when the exposed conductors 22 of the flat circuit body 2 have stiffness, for example, when the conductors 22 are flat, are crimped terminals or the like. The flat circuit body 2 is a collective name of the existing ones such as FPC (flexible print circuit) or FFC (flexible flat cable).

Figure 4:
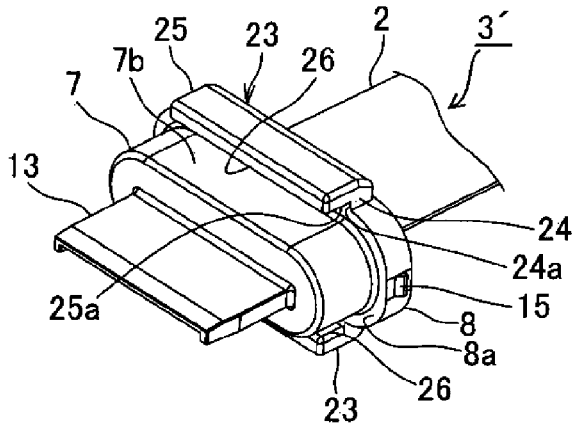
FIG. 4 is a perspective view which shows a variation of the flat circuit side connector shown in FIG. 1.

FIG. 4 shows an example in which, instead of the projecting walls 14 which are the reinforcing parts in FIG. 2, a pair of top and bottom projecting walls 23 which are curved forward into generally L shapes (hook) are provided integrally with the top and bottom of the flange part 8 as reinforcing parts. The projecting walls 23 include vertical, short rising wall parts (projecting walls) 24 which have a shape of expanding the projecting walls 14 in FIG. 2 in the up-down direction, and long projecting plate parts 25 which project forward horizontally from the upper end parts of front end surfaces 24*a* of the rising wall parts 24. Inner surfaces 25*a* of the projecting plate parts 25 are opposed to and parallel to top and bottom outer surfaces 7*b* of the block part 7 so that groove parts 26 are formed between the inner surfaces 25*a* and the outer surfaces 7*b*.

When the two connectors 3' and 4 are fitted, the rising wall parts 24 are fitted with the cut parts 16 of the second connector 4 in FIG. 1, and the inner surfaces 25*a* of the projecting plate parts 25 contact with outer surfaces 10*c*' of the first peripheral wall 10. The operations are described below in detail. The front end surfaces 24*a* of the rising wall parts 24 follow the same surface as the front end surface 8*a* of the flange part 8. Since the configurations of the first connector 3' in FIG. 4 are the same as that in FIG. 2 except the projecting walls 23, the detailed description is omitted by giving the same numbers to the same components. A number 13 shows a contact cover, 2 shows a flat circuit body, and 15 shows locking projections, respectively.

Figure 5:
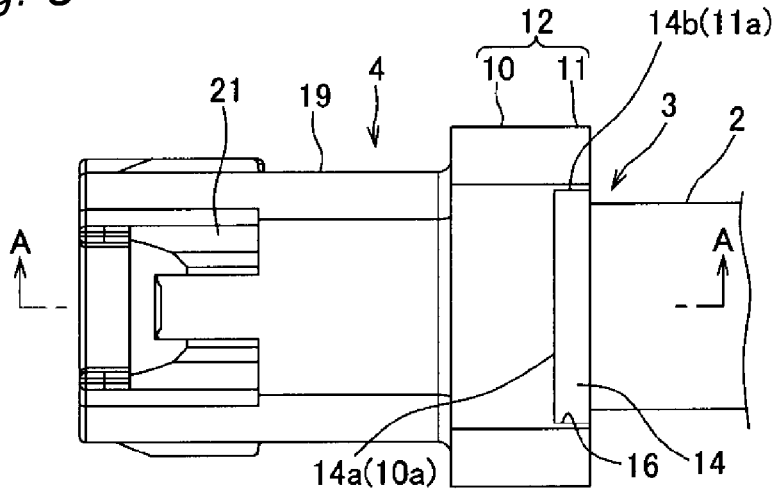
FIG. 5 is a top view which shows that two connectors shown in FIG. 1 are fitted.
Figure 6:
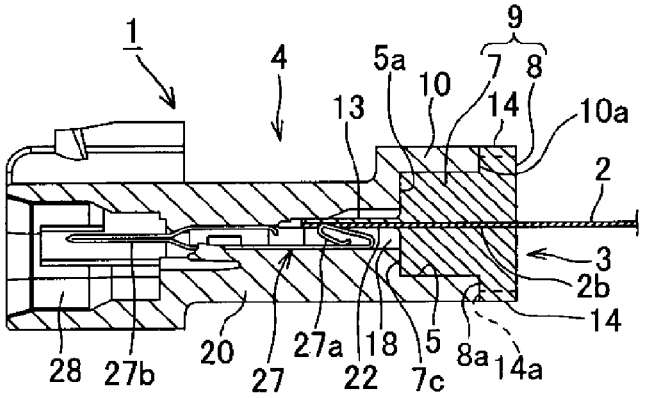
FIG. 6 is an A-A sectional view of FIG. 5 which shows that the two connectors shown in FIG. 1 are fitted.

FIGS. 5 to 6 show that the connectors 3 and 4 in FIG. 1 are fitted. As shown in FIG. 6, the first connector 3 has the fitted part 9 which is solidly filled by resin in the up-down and right-left direction (the board thickness direction and the width direction) of the end part 2*b* of the flat circuit body 2, and the conductors 22 which are exposed as terminals from the bottom surface of the contact cover 13. The end part 2*b* penetrates through the fitted part 9, and has the exposed conductors 22 at the front side.

The block part 7 at the front side is fitted almost without a gap in the connector fitting room 5 at the inner side of the first peripheral wall 10 of the second connector 4, the flange part 8 at the rear side is fitted almost without a gap at the inner side of the second peripheral walls 11 at the rear side, and the top and bottom projecting walls 14 of the flange part 8 are fitted without a gap in the cut parts 16 between the second peripheral walls 11. The front end surface 7*c* of the block part 7 abuts against the bottom wall 5*a* of the connector fitting room 5, and the front end surfaces 8*a*, 14*a* of the flange part 8 and the projecting walls 14 abut against the distal end surface 10*a* of the first peripheral wall 10. The top surface and the bottom surface of the top and bottom projecting walls 14 are positioned on the same plane as the top surface and the bottom surface of the first peripheral wall 10. The rear surfaces of the projecting walls 14 and the rear surface of the flange part 8 are positioned on the same plane as the distal end surfaces (the rear end side surfaces) of the second peripheral walls 11.

There is no wobble between the block part 7 and the flange part 8 as the fitted part (fixed part) 9 and the second connector 4. The projecting walls (the reinforcing parts) 14 are used to prevent an external force received by the flat circuit body 2 or the fitted part 9 from the outside from being transmitted to the contacts of terminals 22, 27 of the two connectors 3, 4.

The locking frames 17 of the second connector 4 in FIG. 1 are flexible in the right-left direction, in other words, the width direction of the flat circuit body 2 to allow the insertion of the locking projections 15 of the first connector 3 so that the second peripheral walls 11 and the flange part 8 are fitted without a gap. Thereby, when the right and left locking frames 17 and the locking projections 15 are fitted, even when an external force is applied in the right-left direction, in other words, the width direction of the flat circuit body 2, since the second peripheral walls 11 at the right and left sides abut against the right and left semicircular outer surface parts 8*c* (refer to FIG. 2) of the flange part 8, the external force is blocked so that a wobble in the right-left direction is prevented.

Even when an external force is applied in the up-down direction, in other words, the thickness direction of the flat circuit body 2, since the right and left semicircular outer surface parts 8*c* of the flange part 8 abut against the inner peripheral surfaces of the second peripheral walls 11, the external force is blocked. Moreover, the front end surfaces 14*a* of the projecting walls 14 and the front end surface 8*a* of the flange part 8 abut against the distal end surface 10*a* of the first peripheral wall 10 by a large area. Thereby, a wobble in the up-down direction is prevented.

When an external force in the right-left direction is applied, since the right and left side end surfaces 14*b* (refer to FIG. 2) of the pair of the projecting walls 14 which are provided on the top and bottom surfaces of the flange part 8 parallel to the main surface of the flat circuit body 2 abut against the end surfaces 11*a* of the second peripheral wall 11 at the cut parts 16, a wobble in the right-left direction is prevented. Since the front end surface 7*c* of the block part 7 abuts against the bottom wall 5*a* of the connector fitting room 5, and the front end surfaces 14*a* of the projecting walls 14 and the front end surface 8*a* of the flange part 8 abut against the distal end surface 10*a* of the first peripheral wall 10, a wobble in the front-rear direction is prevented. Because a wobble in the directions is prevented in this way, abrasion of the conductors 22 of the flat circuit body 2 and mating terminals 27 (refer to FIG. 6) is prevented and electrical contact is well maintained.

As shown in FIG. 6, the terminal accommodating rooms 18 which are connected to the connector fitting room 5 are provided in the housing 20 of the second connector 4, and the terminals 27 are accommodated in the terminal accommodating rooms 18. The terminal 27 in this example has a female electrical contact part (also referred to by the number 27*a*) including an elastic contact part 27*a* at one side and a male electrical contact part 27*b* at the other side, and the male electrical contact part 27*b* is projected into a connector fitting room 28 at the other side of the housing 20.

A plurality of the terminals 27 are arranged to correspond respectively to the conductors 22 of the flat circuit body 2, and the elastic contact parts 27*a* of the terminals 27 elastically contact with the exposed conductors 22. It is also possible to replace the electrical contact parts 27*b* on the other side with electric wire connecting parts (not shown in the figure), and crimp and connect electric wires (not shown in the figure) to the electric wire connecting parts, and in this case, the connector fitting rooms 28 on the other side are replaced with a wire drawout hole.

Figure 7:
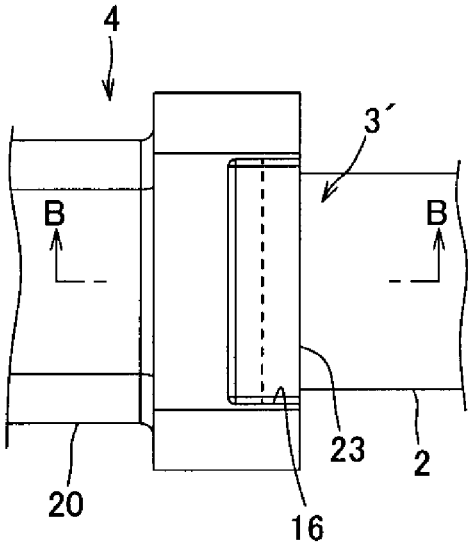
FIG. 7 is a top view which shows that connectors for the variation of FIG. 4 are fitted.
Figure 8:
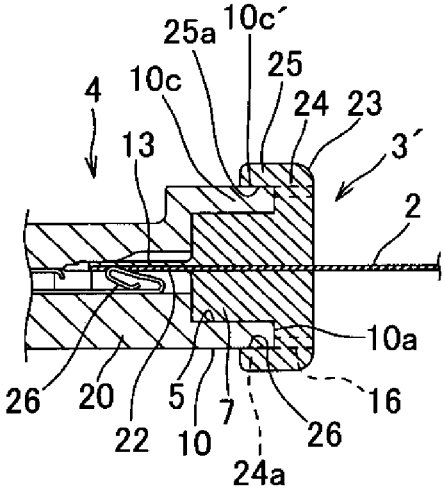
FIG. 8 is a B-B sectional view of FIG. 7 which shows that the connectors for the variation of FIG. 4 are fitted.

FIGS. 7 and 8 show that the first connector 3' in FIG. 4 is fitted with the second connector 4 in FIGS. 5 and 6.

The rising wall parts 24 of the projecting walls 23 which are formed into generally L shapes as top and bottom reinforcing parts of the first connector 3' are fitted into the top and bottom cut parts 16 of the housing 20 of the second connector 4. Thereby, the front end surfaces 24*a* of the rising wall parts 24 abut against the distal end surface 10*a* of the first peripheral wall 10 of the housing 20, the projecting plate parts 25 of the projecting walls 23 are overlapped on the outside of the top and bottom wall parts 10*c* of the first peripheral wall 10, and the inner surfaces 25*a* of the projecting plate parts 25 contact with the outer surface 10*c*' of the first peripheral wall 10.

The block part 7 of the first connector 3' is fitted in the connector fitting room 5 inside the first peripheral wall 10 of the second connector 4, and the top and bottom wall parts 10*c* of the first peripheral wall 10 are fitted in the groove parts 26 between the top and bottom outer surfaces 10*c*' of the block part 7 and the inner surfaces 25*a* of the projecting plate parts 25. Since the top and bottom wall parts 10*c* of the first peripheral wall 10 are held in the groove parts 26, compared with the example in FIGS. 5 and 6, a wobble in the up-down direction between the two connectors 3' and 4 is prevented more surely.

FIGS. 9 to 15 show the flat circuit connector of the second embodiment according to the present invention.

A flat circuit connector 31 is characterized in that an elastic sealing member 32 made of synthetic rubber such as an O ring and a cyclic packing is installed onto the block part 7 of a first connector 33. Since the other components are the same as those of the connector 1 of the first embodiment, the detailed description is omitted by giving the same numbers to the same components. The sealing member 32 is not limited to be installed onto the block part 7, but may be fixed integrally to the block part 7 made by synthetic resin, for example, by two color molding.

Figure 9:
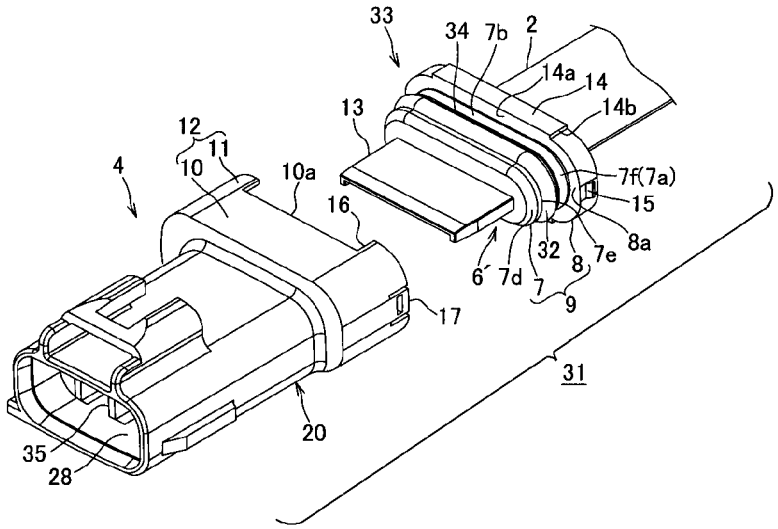
FIG. 9 is an exploded perspective view of a flat circuit connector of a second embodiment according to the present invention.

As shown in FIG. 9, the first connector 33 integrally includes the end part 2*b* of the flat circuit body 2 such as FPC or FFC and a resin molded part 6' which has the fitted part 9 which includes the block part 7 and the flange part 8 made of insulative resin and the contact cover 13 which projects forward from the fitted part 9. The sealing member 32 is installed in a peripheral groove 34 which is provided in the middle part in the front-rear direction of the outer peripheral surface of the block part 7 which has a generally ellipse shape when viewed from the front.

A block front part, which has a large front end taper surface 7*d* for the insertion of the sealing member and a narrow cyclic outer surface 7*e* which is connected to the taper surface 7*d*, is positioned at the front side of the peripheral groove 34, and a block rear part which has a flat cyclic outer surface 7*f* is positioned at the rear side of the peripheral groove 34. The cyclic outer surfaces 7*e*, 7*f* are equivalent to the outer peripheral surfaces (the curved surfaces 7*a*, the flat surfaces 7*b*) in the example in FIG. 2. The flange part 8 at the rear end has projecting walls 14 as reinforcing parts at the top and bottom, and has locking projections 15 at the right and left sides.

The second connector 4 is similar to the first embodiment in FIG. 1, and has the peripheral wall part 12, which has the first peripheral wall 10 and the second peripheral walls 11 integrally connected behind the first peripheral wall 10, at the rear part of the housing 20 made of insulative resin, the pair of cut parts 16 which are at the top and bottom of the second peripheral wall 11 and in which the projecting walls 14 are fitted. The right and left side surfaces of the second peripheral walls 11 are provided with flexible locking frames 17 which are engaged with the locking projections 15. The housing 20 has a connector fitting room 5 (refer to FIG. 1) inside the first peripheral wall 10 and a connector fitting room 28 which is partitioned partially by separating wall 35*s* at the front part.

Figure 10:
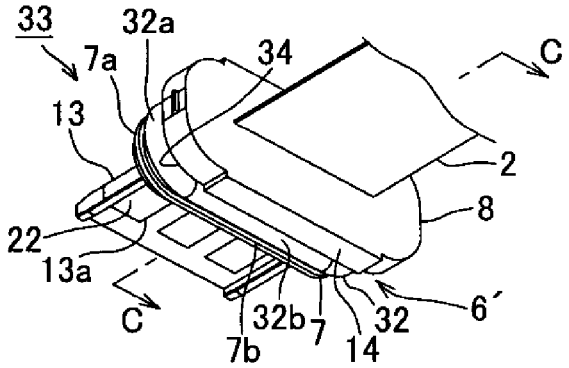
FIG. 10 is a perspective view of a flat circuit side connector shown in FIG. 9 which is viewed from below.

As shown in FIG. 10, the flat circuit body 2 is derived rearward from the center in the up-down direction of the flange part 8 of the first connector 33. The flat circuit body 2 penetrates through the flange part 8 and the block part and is fixed to the flange part 8 and the block part 7. A plurality of paralleled conductors 22 of the end part 2*b* of the flat circuit body 2 are exposed and positioned on the bottom surface of the contact cover 13 which projects forward from the block part 7. The sealing member 32 includes top and bottom straight parts 32*b* along the top and bottom flat parts 7*b* of the block part 7 and semicircular curved parts 32*a* along the curved parts 7*a* at the right and left sides of the block part 7. The flat circuit body 2, the resin molded part 6' and the sealing member 32 construct a flat circuit assembly.

Figure 11:
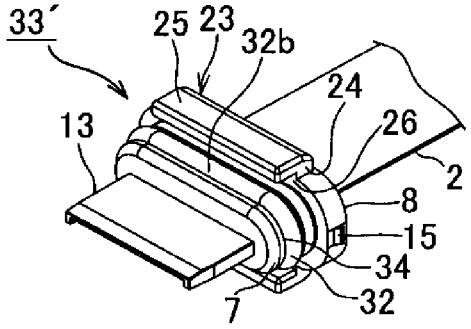
FIG. 11 is a perspective view which shows a variation of the flat circuit side connector shown in FIG. 9.

FIG. 11 shows an example of a first connector 33' in which the projecting walls 23 in FIG. 4 of the first embodiment are provided on the top and bottom of the flange part 8 to replace the projecting walls 14 in FIG. 10, and the top and bottom projecting plate parts 25 of the projecting walls 23 are positioned at the upper side and the lower side of the top and bottom straight parts 32*b* of the sealing member 32 which is installed in the peripheral groove 34 of the block part 7. A number 13 shows a contact cover, 15 shows locking projections and 2 shows a flat circuit body, respectively.

Figure 12:
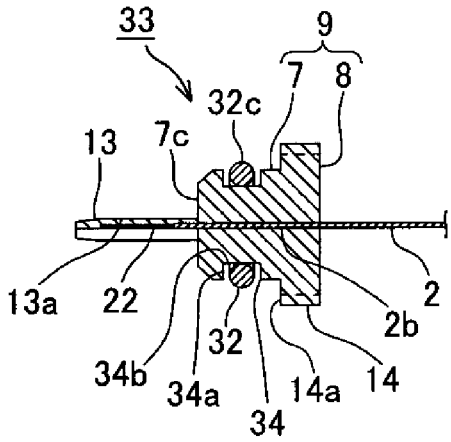
FIG. 12 is a C-C sectional view of FIG. 10 which shows the flat circuit side connector shown in FIG. 9.

FIG. 12 shows a longitudinal section of the first connector 33 in FIG. 10, the sealing member 32 in this example is formed to have a circular section, the outer peripheral surface 32*c* of the sealing member 32 projects to be higher than the outer surface of the block part 7, and the flange part 8 and the top and bottom projecting walls 14 project to be higher than the sealing member 32. The peripheral groove 34 has front and rear vertical inner surfaces 34*a* and a horizontal bottom surface 34*b*. The fitted part 9 is resin molded at the end part 2*b* of the flat circuit body 2, and the exposed conductors 22 of the end part 2*b* are accommodated in grooves at the inner surface side of the upper board part 13*a* of the contact cover 13.

Figure 13:
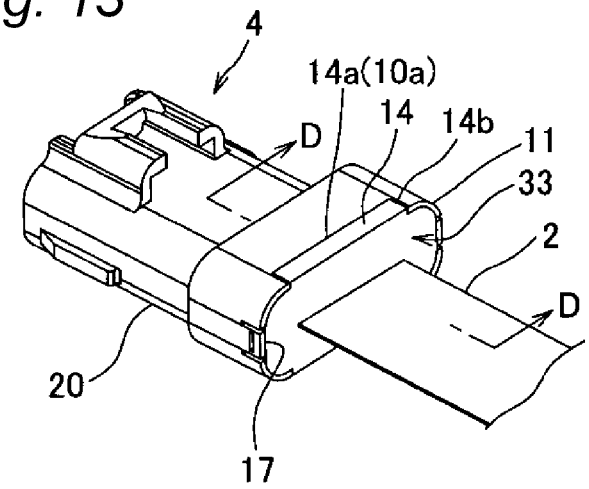
FIG. 13 is a perspective view which shows that two connectors shown in FIG. 9 are fitted.
Figure 14:
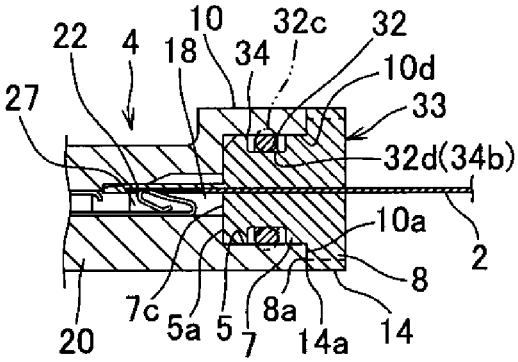
FIG. 14 is a D-D sectional view of FIG. 13 which shows that the two connectors shown in FIG. 9 are fitted.

FIGS. 13 and 14 show that the two connectors 4, 33 in FIG. 9 are fitted. As shown in FIG. 13, the top and the bottom projecting walls 14 of the first connector 33 are fitted in the top and bottom cut parts 16 of the second connector 4, the front end surfaces 14*a* of the projecting walls 14 abut against the bottom surfaces (the distal end surface 10*a* of the peripheral wall 10) of the cut parts 16, the right and left end surfaces 14*b* of the projecting walls 14 abut against the right and left end surfaces (the end parts of the second peripheral walls 11) 11*a* of the cut parts 16, and the right and left locking projections 15 are engaged with the right and left locking frames 17. Thereby, a wobble in an up-down or right-left direction of the two connectors 4, 33 is prevented.

As shown in FIG. 14, the outer peripheral surface 32*c* of the sealing member 32 of the first connector 33 is elastically adhered to the inner surface 10*d* of the first peripheral wall 10 of the second connector 4, and the inner peripheral surface 32*d* of the sealing member 32 is elastically adhered to the bottom surface (the inner surface) 34*b* of the peripheral groove 34. Thereby, water can be prevented from leaking into the connector fitting room 5 from the cut parts 16 or the second peripheral walls 11. The sealing member 32 is compressed in the radial direction between the bottom surface 34*b* of the peripheral groove 34 and the inner surface 10*d* of the first peripheral wall 10 to prevent a wobble between the block part 7 and the first peripheral wall 10 by the elastic counterforce.

The block part 7 is fitted in the connector fitting room 5, the front end surface 7*c* of the block part 7 abuts against the bottom wall 5*a* of the connector fitting room 5, and the front end surface 8*a* of the flange part 8 and the front end surfaces 14*a* of the projecting walls 14 abut against the distal end surface 10*a* of the first peripheral wall 10 on the same plane. Since the projecting walls 14 of the fitted part 9 of the first connector 33 is fitted in the cut parts 16 of the second connector 4 and the flange part 8 is fitted in the second peripheral walls 11, a wobble of the fitted part 9 and the housing 20 of the second connector 4 is prevented. Thereby, unfavorable deformation of the sealing member 32 is prevented, and the sealing performance of the sealing member 32 is well maintained. The terminals 27 in the terminal accommodating room 18 which communicates with the connector fitting room 5 elastically contact with the exposed conductors 22 of the flat circuit body 2.

Figure 15:
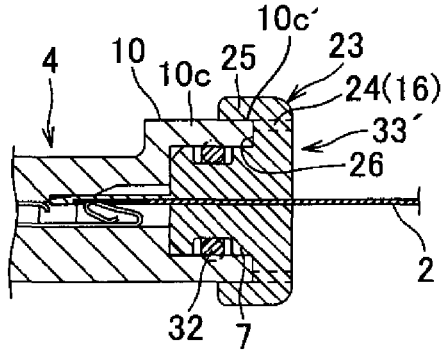
FIG. 15 is a longitudinal sectional view which shows that the connectors in the variation in FIG. 11 are fitted.
Figure 16:
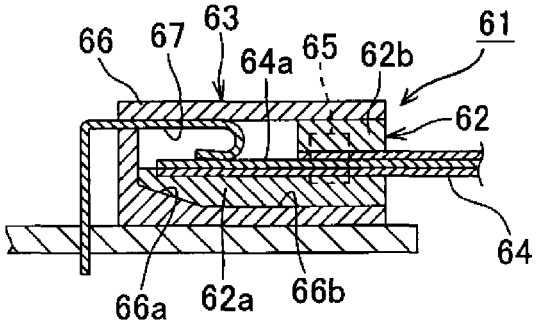
FIG. 16 is a longitudinal sectional view which shows an example of a conventional flat circuit connector in a fitted state.
Figure 17:
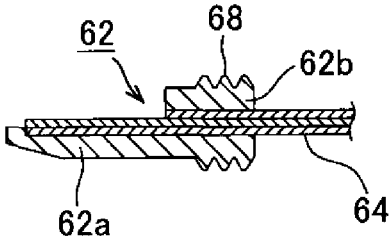
FIG. 17 is a longitudinal sectional view which shows a variation of a conventional flat circuit side connector.

FIG. 15 shows that the first connector 33' in the example in FIG. 11 is fitted with the same second connector 4 as the example in FIG. 14. The rising wall parts (projecting walls) 24 of the projecting walls 23 of the first connector 33', like the projecting walls 14 in the example in FIG. 14, are fitted in the cut parts 16 of the second connector 4, the projecting plate parts 25 contact with the outer surface 10*c'* of the first peripheral wall 10, and the top and bottom wall parts 10*c* of the first peripheral wall 10 are fitted in the groove parts 26 between the projecting plate parts 25 and the block part 7. Thereby, a wobble in the up-down direction between the two connectors 4 and 33' is prevented more surely so that unfavorable deformation of the sealing member 32 is prevented, and the sealing performance of the sealing member 32 is well maintained.

In each of the previously described embodiments, the terminals 27 are provided at the second connector 4, but it is also possible that the flat circuit body (2) is provided in the first connector 3 to replace the terminals 27, and terminals (not shown in the figure) which has elastic contact parts 27*a* are provided to be connected to the terminal connectors (22) of the flat circuit body (2).

Although the invention is described in detail with reference to the specific embodiments, it is apparent that various modifications and amendments may be made by those skilled in the art without departing from the spirit and scope of the invention.

The flat circuit connector according to the present invention can prevent a wobble of the connectors relative to each other when an external force is applied on the flat circuit body.

The invention claimed is:

1. A flat circuit connector comprising:

a first connector which is resin molded at an end part of a flat circuit body; and a second connector, including a terminal configured to connect to a conductor provided in the end part, and configured to be fitted with the first connector, wherein the first connector includes a block part made of resin and a flange part, the flange part is integrally formed at a rear side in a direction in which the block part is fitted and has a diameter larger than a diameter of the block part, a projecting wall is provided on a surface of the flange part which is parallel to a main surface of the flat circuit body, the projecting wall defining a planar upper surface that extends parallel to the surface of the flange part and the main surface of the flat circuit body, the second connector includes a first peripheral wall with which the block part is fitted, and a second peripheral wall which is integrally formed at the rear side of the first peripheral wall in the direction in which the block part is fitted, and the second peripheral wall is formed with a cut part in which the projecting wall is fitted.

2. The flat circuit connector according to claim 1, wherein the second peripheral wall is provided with a locking part which is flexible in a width direction of the flat circuit body, and the flange part is provided with a locked part configured to be engaged with the locking part.

3. The flat circuit connector according to claim 1, wherein a groove part is provided between the block part and a projecting plate part which is provided forward at a distal end part of the projecting wall at a front side in the direction in which the block part is fitted, and the first peripheral wall is configured to be fitted in the groove part.

4. The flat circuit connector according to claim 1, wherein an elastic sealing member is provided on an outer periphery of the block part, and the sealing member adheres to an inner surface of the first peripheral wall.

5. The flat circuit connector according to claim 1, wherein the projecting wall is defined by a rectangular cuboid.

6. The flat circuit connector according to claim 1, wherein the planar upper surface of the projecting wall is elongated, the direction of elongation of the projecting wall being perpendicular to a direction of elongation of the main surface of the flat circuit body.

7. The flat circuit connector according to claim 6, wherein the projecting wall is configured to extend along a majority of length of the surface of the flange part in its direction of elongation.

8. The flat circuit connector according to claim 1, wherein the projecting wall defines a rear surface that is configured to be disposed rearwardly from a rear surface of the second peripheral wall when the projecting wall is fitted to the second peripheral wall.

* * * * *